US005640185A

United States Patent [19]

Kagayama

[11] Patent Number: 5,640,185

[45] Date of Patent: Jun. 17, 1997

[54] IMAGE RECORDING APPARATUS HAVING APERTURE ELECTRODE WITH TENSION APPLICATION MEANS AND TENSION INCREASING MEANS AND OPPOSING ELECTRODE FOR APPLYING TONER IMAGE ONTO IMAGE RECEIVING SHEET

[75] Inventor: Shigeru Kagayama, Owariasahi, Japan

[73] Assignee: Brother Kogyo Kabushiki Kaisha, Nagoya, Japan

[21] Appl. No.: 392,193

[22] Filed: Feb. 22, 1995

[30] Foreign Application Priority Data

Mar. 2, 1994 [JP] Japan ..... 6-032121

[51] Int. Cl.[6] ..... B41J 2/06

[52] U.S. Cl. ..... 347/55; 347/141; 399/259

[58] Field of Search ..... 347/55, 141, 151; 355/261, 262

[56] References Cited

U.S. PATENT DOCUMENTS

| | | | |
|---|---|---|---|
| 3,689,935 | 9/1972 | Pressman et al. | 347/55 |
| 4,743,926 | 5/1988 | Schmidlin et al. | 347/55 |
| 4,755,837 | 7/1988 | Schmidlin et al. | 347/55 |
| 4,780,733 | 10/1988 | Schmidlin | 347/55 |
| 4,814,796 | 3/1989 | Schmidlin | 347/55 |
| 4,912,489 | 3/1990 | Schmidlin | 347/55 |
| 5,036,341 | 7/1991 | Larsson | 347/55 |

FOREIGN PATENT DOCUMENTS

| | | |
|---|---|---|
| 587366A1 | 3/1994 | European Pat. Off. . |

*Primary Examiner*—Benjamin R. Fuller
*Assistant Examiner*—Charlene Dickens
*Attorney, Agent, or Firm*—Oliff & Berridge

[57] ABSTRACT

An image recording apparatus having a flexible aperture electrode body, a toner carrier roller, a toner case, and an electrically conductive opposing electrode. The aperture electrode selectively allows toners supplied by the toner carrier roller to pass through the aperture. An image receiving sheet is backed by the opposing electrode, and the toner passing through the aperture electrode is attracted onto the sheet. The aperture electrode body has both ends fixed to an attachment member. The toner case provides a pair of ribs in contact with the aperture electrode body so as to increase tension thereto.

14 Claims, 4 Drawing Sheets

IMAGE RECORDING APPARATUS HAVING APERTURE ELECTRODE WITH TENSION APPLICATION MEANS AND TENSION INCREASING MEANS AND OPPOSING ELECTRODE FOR APPLYING TONER IMAGE ONTO IMAGE RECEIVING SHEET

BACKGROUND OF THE INVENTION

The present invention relates to an image recording apparatus for use in copying machines, printers, and facsimiles, etc.

As described in a U.S. Pat. No. 3,689,935, in the image recording apparatus of this kind, electric potential is applied to a selected one of the plurality of aperture electrodes in accordance with image data, so that the charged toners pass through the aperture electrode to form a toner image onto an image receiving member provided on an opposing electrode.

The apparatus described provides a flat plate formed of a dielectric material, a continuous conductive reference electrode provided at one surface of the plate, and a plurality of control electrodes consisting of a plurality of insulatively isolated conductive segments provided at the opposite surface of the plate. Aperture penetrates through the flat plate, the continuous conductive electrode and the control electrode to provide at least one row of the aperture electrodes. The apparatus further includes means for selectively applying electric potentials between the reference electrode and the control electrode, means for projecting charged toners through the aperture whereby flow of the toners is modulated according to the potentials, and means for positioning the image receiving member in the path of flow of the toners so as to provide relative translation between the image receiving member and the aperture electrode.

U.S. Pat. Nos. 4,743,926, 4,755,837, 4,780,733 and 4,814,796 disclose an image recording apparatus in which control electrode faces the image receiving member and the reference electrode faces the toner supply means. On the other hand, U.S. Pat. No. 4,912,489 discloses the reference electrode facing the image receiving member and the control electrode facing the toner supply means. With this arrangement, electric voltage applied to the control electrode could be reduced to approximately one to four at OFF state in comparison with the aperture electrode having the reverse arrangement such as the above U.S. Pat. No. '926. Here, OFF state implies no toner attachment to the image receiving member for providing a non-imaged area. Reversely, ON state implies the toner image forming state.

However, according to the above described conventional image recording apparatus, it would be rather difficult to mount the aperture electrode body onto a main body in a desirable mode. That is, the aperture electrode body is formed of a thin film such as 25 micron meters thickness. Therefore, it would be difficult to provide a contact of the aperture electrode body with a toner carrier roller without any wrinkle while applying a tension to the aperture electrode body. If such contact is not provided, contacting condition between the aperture electrode body and the toner carrier roller may be varied, to degrade the imaging quality.

SUMMARY OF THE INVENTION

It is therefore, an object of the present invention to overcome the above described conventional disadvantages and drawbacks and to provide an improved image recording apparatus capable of providing a desirable and stabilized contact between aperture electrode body and a toner carrier, to thus provide a high quality image onto an image receiving member.

This and other objects of the present invention will be attained by an image recording apparatus for forming a toner image on an image receiving medium including a toner carrier, a flexible toner flow control means, an opposing electrode and tension application means. The toner carrier has an outer peripheral surface on which charged toners are carried the toner carrier provides an axial direction. The flexible toner flow control means is disposed in contact with the toner carrier through the charged toners. The toner flow control means has forward edge portion, a rearward edge portion and control portions positioned between the forward and rearward edge portions. A selected one of the control portions provides controlled magnitude of electric field to control toner flow so as to selectively allow the charged toners to pass through the selected one of the control portions. The opposing electrode is disposed in confrontation with the toner flow control means at a position opposite the toner carrier with respect to the toner flow control means. The image receiving medium is passable between the toner flow control means and the opposing electrode. The tension application means is adapted for applying tension to the toner flow control means. The tension application means includes fixing means for fixing the forward and rearward edges of the toner flow control means, and tension increasing means extending in the axial direction of the toner carrier and is in contact with the toner flow control means at a position beside the control portions.

Uniform tension is imparted on the flexible toner flow control means along its length by the tension application means and tension increasing means. Therefore, the toner flow control means can provide a desirable contact with the toner carrier, and the control portions is applied with tension uniform to one another. Thus, high quality image formation results.

BRIEF DESCRIPTION OF THE DRAWINGS

In the drawings;

FIG. 4(*b*) is a cross-sectional view taken along the line IV of FIG. 4(*a*);

FIG. 5(*b*) is a cross-sectional view taken along the line V—V of FIG. 5(*a*).

DETAILED DESCRIPTION OF THE PREFERRED EMBODIMENTS

Figure 1:
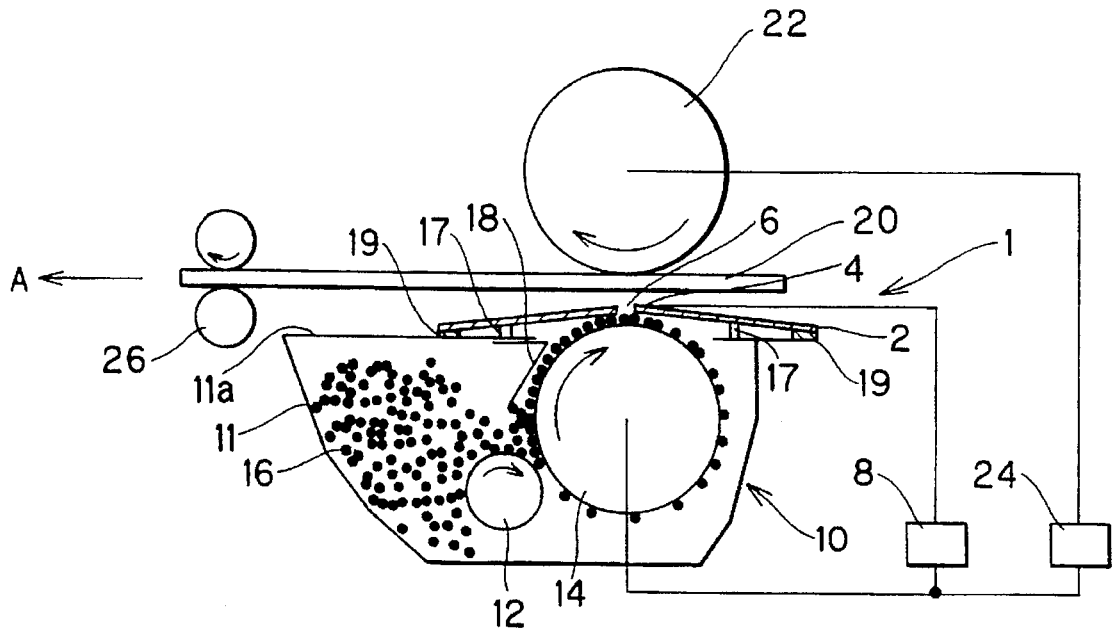
FIG. 1 is a schematic illustration showing an image recording apparatus according to a first embodiment of the present invention.

An image recording apparatus according to a first embodiment of the present invention will be described with reference to FIGS. 1 through 4(*b*).

The apparatus includes a chassis (not shown) to which a cylindrical opposing electrode roller 22 is rotatably supported. An aperture electrode body 1 having an elongated shape is positioned below the opposing electrode roller 22 with a space of 1 mm therebetween. The aperture electrode body 1 serves as a toner flow control means. An image receiving member 20 can be transferred through the space in a direction indicated by an arrow A. A toner supply unit 10 is provided below the aperture electrode body 1 and extends in the lengthwise direction thereof. Further, a fixing unit 26 is provided at the downstream of the aperture electrode body 1.

The toner supplying unit 10 includes a toner case 11 for containing toners 16, a toner supply roller 12 rotatably disposed in the toner case 11, a toner carrier roller 14 and a blade 18. The toner case 11 has a top table 11*a* formed with an opening to expose a part of the toner carrier roller 14. The toner supply roller 12 is positioned nearby the toner carrier roller 14 for supplying toners 16 to the toner carrier roller 14. The toner carrier roller 14 is adapted to rotatably carry the toners 16 and to transfer the toners to the aperture electrode body 1. The blade 18 is positioned in contact with the toner carrier roller 14 for scraping excessive toner from the surface of the toner carrier roller 14 and to provide a uniform charging to the toners.

Figure 2:
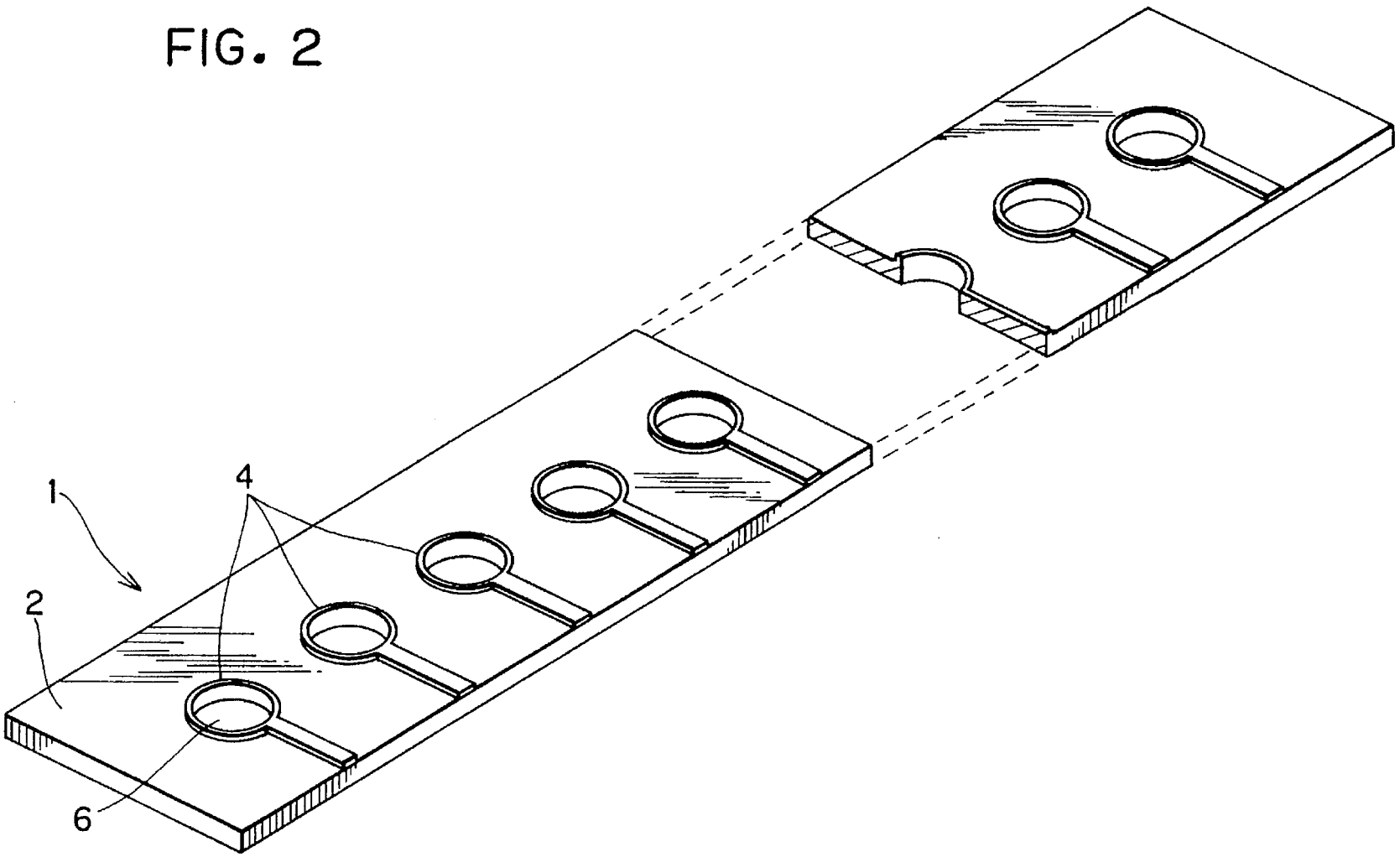
FIG. 2 is a perspective view showing an aperture electrode body in the first embodiment.

The aperture electrode body 1 is disposed on the top table 11a, and is in contact with the part of the toner carrier roller 14, the part being protruded from the opening of the top table 11*a*. As best shown in FIG. 2, the aperture electrode body 1 includes an electrically insulating layer 2 and a plurality of control electrodes 4 provided upon the insulating layer 2 and arrayed in line. A plurality of apertures 6 are formed to penetrate the control electrodes 4 and the insulating layer 2. Thus, the control electrodes 4 are disposed around the apertures 6.

The insulating layer 2 is formed of a polymer film such as a polyimide and has a thickness of 25 micron meters. The control electrodes 4 are made of an electrically conductive material having a thickness of 1 micron meter. Each of the apertures 6 has a diameter of 100 micron meters. A combination of the aperture 6 and the control electrode 4 serves as a control portion. As best shown in FIG. 1, the control electrode 4 of the aperture electrode body 1 confronts the image receiving member 20, while the insulative layer 2 is in contact with the toner carrier roller 14 at the positions of the apertures 6.

A voltage applying circuit 8 is provided between the control electrodes 4 and the toner carrier roller 14 for applying potentials to each of the control electrodes 4. This circuit selectively applies toner passable voltage of +50 V and toner blocking voltage of 0 V to selected control electrodes 4. Further, a DC power source 24 is connected between the opposing electrode 22 and the toner carrier roller 14 to supply +1 KV to the opposing electrode 22.

Figure 3:
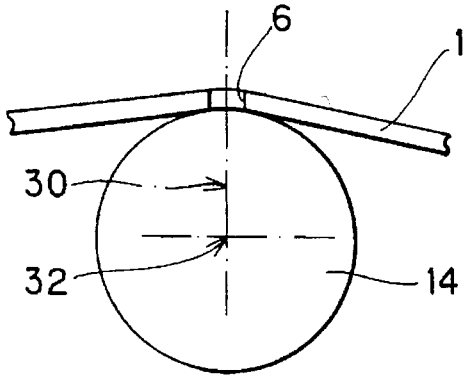
FIG. 3 is a schematic view showing the geometrical relationship between the aperture electrode body and a toner carrier roller in the first embodiment.

As shown in FIG. 3, each center line 30 of the apertures 6 passes through the uppermost area and a rotational center 32 of the toner carrier roller 14. With this arrangement, each of the apertures is positioned symmetrically with respect to the uppermost line of the toner carrier roller 14, whereby toners 16 passing through each aperture 6 are distributed uniformly. Further, wall of the apertures 6 can be made parallel to the flowing direction of the toners 16, so that stabilized toner flowing results.

Furthermore, the aperture electrode body 1 is bent as shown in FIG. 3 symmetrically with respect to the center line 30. Therefore, tangential angle of the left side of the electrode body 1 is equal to that of the right side thereof as shown in FIG. 3. With this arrangement, contacting area between the aperture electrode body 1 and the toner carrier roller 14 can be increased, and the lower opening edge area of each aperture can be uniformly pressure-contacted with the toner carrier roller 14, to reduce irregularity of the toner image density.

Attachment manner of the aperture electrode body 1 will next be described with reference to FIGS. 4(*a*) and 4(*b*). The insulative sheet 2 of the aperture electrode body 1 has forward and rearward edges in the running direction A of the image receiving member 20, and each edge is fixed to an attachment frame 19, so that the insulative sheet 2 is held under tension. The attachment frame 19 is fixed to the top wall 11*a* of the toner case 11. Further, a pair of ribs 17, 17 protrude from the top wall 11*a* of the toner case 11 and extend in a direction substantially perpendicular to the running direction A of the image receiving member 20. In other words, these ribs 17 and 17 extend in an axial direction of the toner carrier roller 14.

These ribs 17, 17 are positioned within an area surrounded by the attachment frame 19. Each of the ribs 17 extends arcuately, so that distance between each intermediate portion of the ribs 17 and 17 is the smallest, and the distance between the ribs 17 and 17 becomes increased toward their ends as shown in FIG. 4(*a*). Incidentally, the insulative sheet 2 is fixed to the attachment frame 19 in such a manner that each aperture 6 is positioned at a center portion between the arcuate ribs 17 and 17. In other words, an array of the apertures 6 divide the distance between the ribs 17 and 17 into halves.

In the state where the insulative sheet 2 is fixed to the attachment frame 19, the top surfaces of the arcuate ribs 17, 17 are in pressure contact with the lower surface of the insulative sheet 2 to increase tension thereof. In this case, with respect to the area of the insulative sheet 2, the area being defined by the pair of arcuate ribs 17, the tension applied to the narrow distant portion between the intermedaite portions of the ribs 17 and 17 is lower than that applied to the wide distant portion between the end portions of the ribs 17 and 17.

In addition to such a tension distribution, the aperture electrode body 1 is held on the toner carrier roller 14. Therefore, contacting manner between the aperture electrode body 1 and the toner carrier roller 14 is stabilized along the length of the aperture electrode body 1.

Operation of the image recording apparatus will next be described. In accordance with the rotation of the toner carrier roller 14 and the toner supply roller 12 in the direction indicated by arrows in FIG. 1, the toner supplied from the toner supply roller 12 are rubbingly transferred onto the toner carrier roller 14, and the toners are negatively charged to be held on the toner carrier roller 14. The toner layer on the toner carrier roller 14 is further charged and scraped by the toner scraper blade 18, so that the toner layer becomes a thin layer, which is transferred toward the aperture electrode body 1. The toners on the toner carrier roller 14 are rubbed by the insulative sheet 2 of the aperture electrode body 1 and are supplied to a position below the apertures 6.

In accordance with the image recording signal, +50 V is applied to the selected one of the control electrode 4. As a result, electric line of force directed from the control electrode 4 to the toner carrier roller 14 is generated because of the potentials between the control electrode 4 and the toner carrier roller 14. Thus, the negatively charged toners undergo electrostatic force toward the high potential side, so that the toners are flowed from the toner carrier roller 14 to the control electrode 4 through the aperture 6. These toners 16 are further flowed toward the image receiving member 20 and are deposited thereon because of the electric field generated between the image receiving member 20 and the aperture electrode body 1, the electric field being provided by the voltage applied to the opposing electrode 22. Thus, toner pixel can be formed on the image receiving member 20. The control electrode 4 produces electric field between the control electrode 4 and the inside of the aperture 6, i.e., the electric field can be directly applied to the toners 16 positioned in confrontation with the aperture and carried on the toner carrier roller 14. Therefore, high controlling efficiency is obtainable. Further, the toner carrier roller 14 confronts the aperture electrode body 1 only through the toner layer, the distance therebetween can be reduced, to thereby lower the control voltage. In other words economical driving element can be used.

The insulative sheet 2 of the aperture electrode body 1 faces the toner carrier roller 14. Therefore, it is possible to avoid short-circuit due to direct contact between the control electrode 4 and the toner carrier roller 14, which direct contact may occur if no toner is supplied on the toner carrier roller 14. Accordingly, destruction of the driving element can be obviated. Further, the aperture electrode body 1 is in contact with the toners 16 on the toner carrier roller 14 at the inlet portion of the aperture 6. Therefore, the toners accumulated at the inlet portion of the aperture 6 is urged to be pressed by the succeeding toners supplied by the toner carrier roller 14. Accordingly, it is possible to avoid solid deposition of the toners due to accumulation and cross-linking of the toners at the inlet portion of the aperture 6.

On the other hand, remaining one of the control electrodes 4 which corresponds to non-imaging area is subjected to zero voltage from the control voltage applying circuit 8. As a result, no electric field is provided between the toner carrier roller 14 and the control electrode 4, to prevent the toners from being flowed through the aperture 6.

Figure 4A:
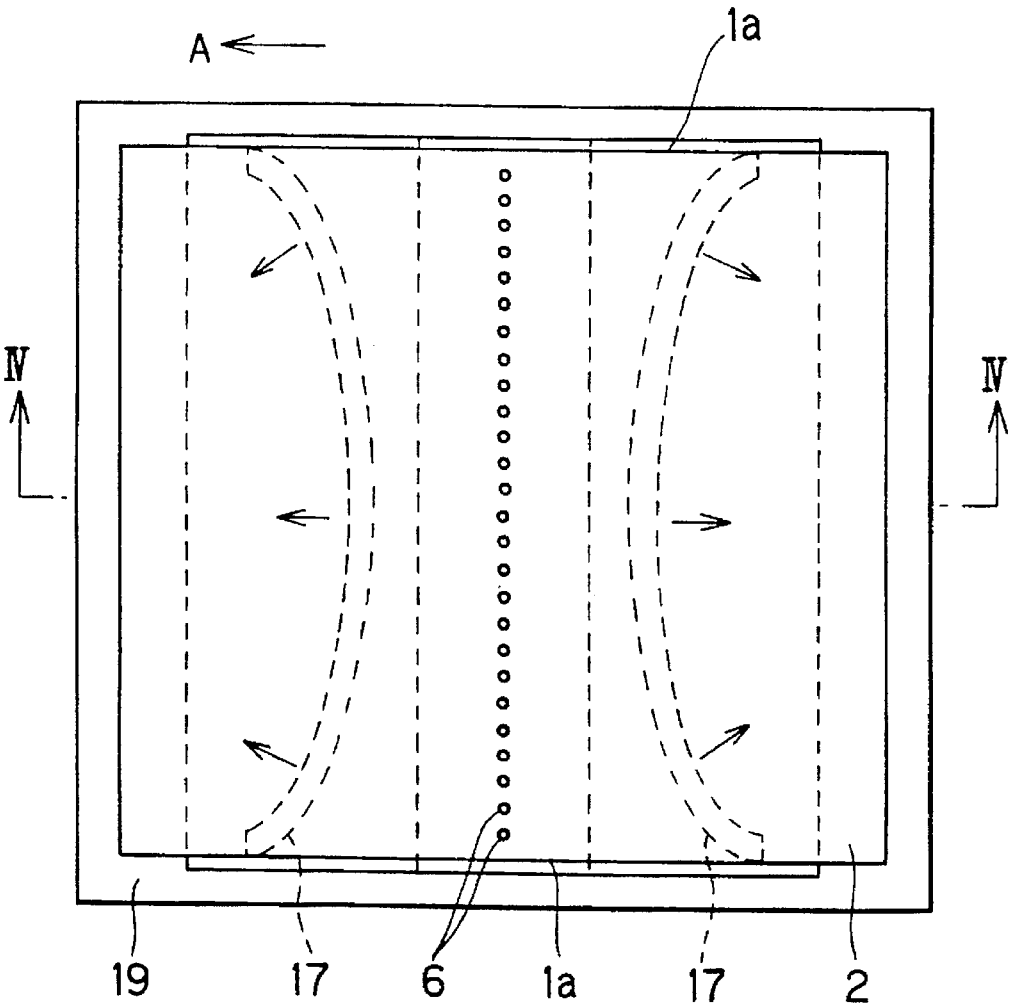
FIG. 4(*a*) is a plan view showing the arrangement of the aperture electrode body and tension application means according to the first embodiment.
Figure 4B:
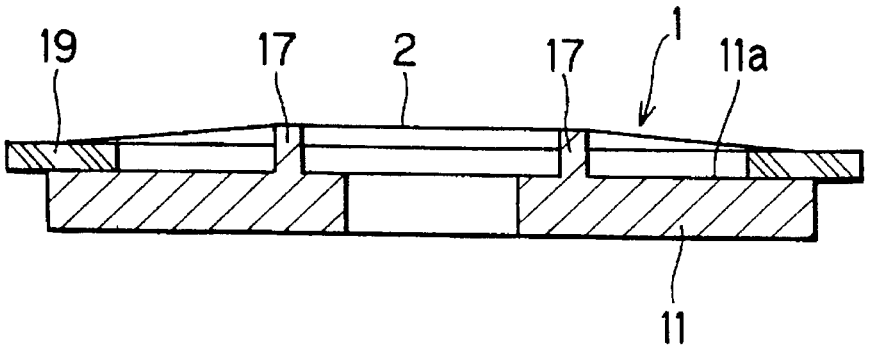

In the image recording process, higher tension is subjected toward the ends of the ribs 17 as shown in FIG. 4(*a*) in the aperture electrode body 1. Accordingly, even the laterally edge portions 1*a*, 1*a* of the aperture electrode body 1 can be imparted with sufficient tension. Thus, tension can be uniformly applied to the overall area of the aperture electrode body 1, and consequently, the aperture electrode body 1 can provide stabilized contact with respect to the toner carrier roller 14 regardless of the particular area of the aperture electrode body 1, to thereby enhance printing quality.

While one row of pixels are formed on the image receiving member 20, the latter is shifted by one pixel in the direction perpendicular to the row of the apertures 6, and the above process is repeatedly carried out to provide toner image on the image receiving member 20. Then, the toner image is fixed to the image receiving member 20 by the fixing unit 26.

Figure 5A:
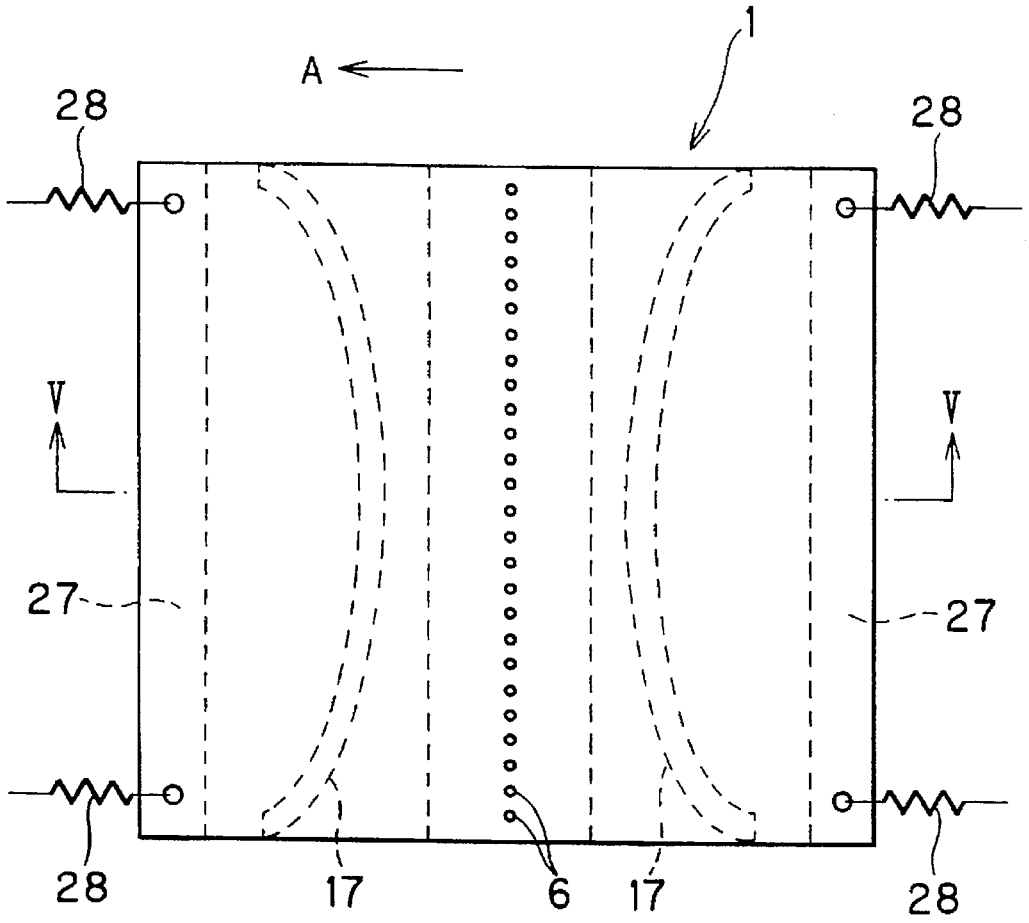
FIG. 5(*a*) is a plan view showing an arrangement of an aperture electrode body and tension application means according to a second embodiment of the present invention.
Figure 5B:
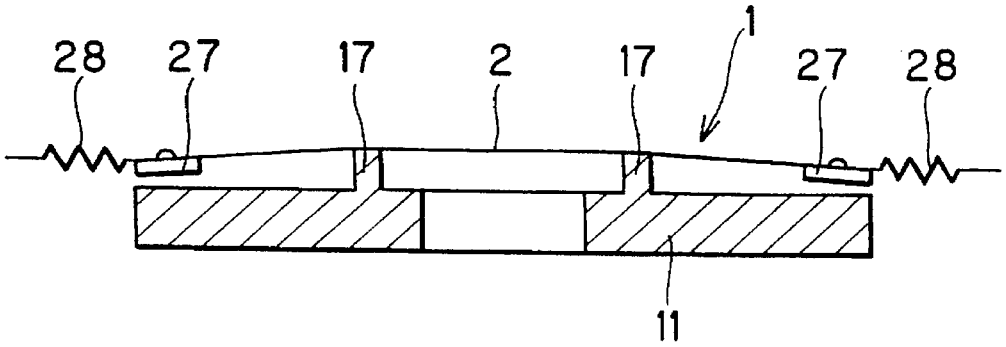

An image recording apparatus according to a second embodiment of the present invention will be described with reference to FIGS. 5(*a*) and 5(*b*). The second embodiment pertains to the modification to the first embodiment in terms of the attachment manner of the insulative sheet 2 of the aperture electrode body 1. In the second embodiment, each of the forward and rearward edges of the insulative sheet 2 is fixed with a reinforcing member 27. Further, a tension spring 28 is interposed between the toner case 11 and the forward reinforcing member 27, and another tension spring 28 is interposed between the toner case 11 and the rearward reinforcing member 27 in such a manner that the insulative sheet 2 is urged to be pressed by the pair of ribs 17 and 17. With this arrangement, the above described advantage similar to the first embodiment is obtainable.

While the invention has been described in detail and with reference to specific embodiments thereof, it would be apparent to those skilled in the art that various changes and modifications may be made therein without departing from the spirit and scope of the invention.

For example, employment of the insulative toners is advantageous in that dielectric relation can be provided between the toner carrier roller 14 and the control electrode 4 to obviate break down of the aperture 6. Further, in the above described embodiments, the control voltage applied to the non imaging aperture is zero volt. However, negative voltage can be applied to the non imaging aperture. In the latter case, resultant image provides a reduced fog. Furthermore, in the illustrated embodiment, the aperture electrode body is used as the toner flow control means. However, a net-like electrode body descried in a U.S. Pat. No. 5,036,341 can also be used instead of the aperture electrode body.

Further, electric field control means can be provided for finely controlling toner passage through the aperture. For example, even if part of the supplied toners are entered into the non-imaging aperture due to the mechanical force created by the sliding contact relative to the aperture electrode body 1, it is possible to prevent the entered toners from passing through the aperture because of the control to the electric field within the aperture. Thus, toner controllability can be enhanced.

What is claimed is:

1. An image recording apparatus for forming a toner image on an image receiving medium comprising:

a toner carrier having an outer peripheral surface on which charged toners are carried, the toner carrier providing an axial direction;

a flexible toner flow control means for controlling toner flow disposed in contact with the toner carrier through the charged toners, the toner flow control means having a forward edge portion, a rearward edge portion and control portions positioned between the forward edge portion and the rearward edge portion, a selected one of the control portions providing controlled magnitude of electric field to control toner flow so as to selectively allow the charged toners to pass through the selected one of the control portions;

an opposing electrode disposed in confrontation with the toner flow control means at a position opposite the toner carrier with respect to the toner flow control means, the image receiving medium being passable between the toner flow control means and the opposing electrode; and the improvement comprising;

tension application means for applying tension to the toner flow control means, the tension application means comprising fixing means for fixing the forward and rearward edges of the toner flow control means, and tension increasing means extending in the axial direction of the toner carrier and being in contact with the toner flow control means at a position beside the control portions.

2. The image recording apparatus as claimed in claim 1, wherein the tension increasing means comprises a pair of ribs positioned beside the control portions, one of the ribs being positioned between the forward edge portion of the toner flow control means and the control portions, and the other ribs being positioned between the rearward edge portion of the toner flow control means and the control portions.

3. The image recording apparatus as claimed in claim 2, wherein the pair of ribs each have an arcuate shape such that distance between the pair of ribs at an intermediate portion of each of the pair of ribs is smaller than the distance between the pair of the ribs at ends of each of the pair of ribs, the distance between the pair of ribs being increased toward the ends of the pair of ribs.

4. The image recording apparatus as claimed in claim 3, wherein the fixing means comprises a stationary attachment frame.

5. The image recording apparatus as claimed in claim 4, further comprising a toner case for accumulating therein toners, the toner case having a top wall, the toner carrier being rotatably disposed in the toner case and partly exposed to the toner flow control means through the top wall, the stationary attachment frame being fixed to the top wall, and the pair of ribs projecting from the top wall.

6. The image recording apparatus as claimed in claim 5, wherein the toner flow control means comprises an aperture electrode body comprising an insulative sheet and control electrodes formed on the insulative sheet, a row of apertures being formed in the insulative sheet and each one of the control electrodes surrounding corresponding one of the apertures, a combination of the apertures and the control electrodes providing the control portions.

7. The image recording apparatus as claimed in claim 6 wherein the insulative sheet is in facing relation to the toner carrier.

8. The image recording apparatus as claimed in claim 7, wherein each center of each aperture is positioned on a line extending between a center of the toner carrier and an uppermost peripheral portion of the toner carrier.

9. The image recording apparatus as claimed in claim 3, wherein the fixing means comprises at least one resilient biasing member connected to one of the forward edge portion and rearward edge portion of the toner flow control means.

10. The image recording apparatus as claimed in claim 9, further comprising a reinforcing member fixed to the forward edge portion and rearward edge portion of the toner flow control means, the resilient biasing member being connected to the reinforcing member.

11. The image recording apparatus as claimed in claim 10, further comprising a toner case for accumulating therein toners, the toner case having a top wall, the toner carrier being rotatably disposed in the toner case and partly exposed to the toner flow control means through the top wall, the pair of ribs projecting from the top wall.

12. The image recording apparatus as claimed in claim 11, wherein the toner flow control means comprises an aperture electrode body comprising an insulative sheet and control electrodes formed on the insulative sheet, a row of apertures being formed in the insulative sheet and each one of the control electrodes surrounding corresponding one of the apertures, a combination of the apertures and the control electrodes providing the control portions.

13. The image recording apparatus as claimed in claim 12, wherein the insulative sheet is in facing relation to the toner carrier.

14. The image recording apparatus as claimed in claim 13, wherein each center of each aperture is positioned on a line extending between a center of the toner carrier and the outer peripheral surface of the toner carrier.

* * * * *